US005956902A

United States Patent [19]

Cosby

[11] Patent Number: 5,956,902

[45] Date of Patent: Sep. 28, 1999

[54] UNDERGROUND MINE PERSONNEL DOORS

[76] Inventor: Larry P. Cosby, 430 E. Center St., Aurora, Utah 84620

[21] Appl. No.: 08/851,005

[22] Filed: May 5, 1997

[51] Int. Cl.[6] ..... E06B 3/32; E05F 11/00

[52] U.S. Cl. ..... 49/463; 49/278

[58] Field of Search ..... 49/504, 380, 394, 49/505, 464, 463, 57, 503, 124, 489.1, 498.1, 276, 278, 277; 110/173; 126/190, 194; 405/132, 150; 16/277; 292/300, 340

[56] References Cited

U.S. PATENT DOCUMENTS

| | | | |
|---|---|---|---|
| Re. 34,053 | 9/1992 | Kennedy et al. | 405/132 |
| 1,043,236 | 11/1912 | Johnson | 292/340 |
| 1,741,940 | 12/1929 | Jacobson | 49/505 |
| 3,404,675 | 10/1968 | Payne | 49/489.1 |
| 3,906,670 | 9/1975 | Burton | 49/381 |
| 4,082,331 | 4/1978 | Kennedy et al. | 292/228 |
| 4,236,501 | 12/1980 | Bitler | 126/197 |
| 4,517,767 | 5/1985 | Dewson | 49/505 |
| 4,716,683 | 1/1988 | Minter | 49/479 |
| 4,822,060 | 4/1989 | Moyer et al. | 49/492 |
| 5,066,028 | 11/1991 | Weil | 49/498.1 |
| 5,085,204 | 2/1992 | Moyer | 49/498.1 |
| 5,168,667 | 12/1992 | Kennedy et al. | 49/394 |
| 5,240,349 | 8/1993 | Kennedy et al. | 405/132 |
| 5,342,123 | 8/1994 | Cole et al. | 49/394 |
| 5,371,987 | 12/1994 | Hirsch et al. | 49/489.1 |
| 5,452,544 | 9/1995 | Weathington, Sr. | 49/394 |
| 5,600,868 | 2/1997 | Tourville et al. | 16/277 |

FOREIGN PATENT DOCUMENTS

| | | |
|---|---|---|
| 89/7815 | 10/1989 | Dem. Rep. of the Congo . |
| 2147652 | 5/1985 | United Kingdom . |

*Primary Examiner*—Daniel P. Stodola
*Assistant Examiner*—Curtis A. Cohen
*Attorney, Agent, or Firm*—Morriss, Bateman, O'Bryant & Compagni, PC

[57] ABSTRACT

A mine door for use in underground mining includes a door panel hingedly mounted to a door frame. A substantially noncombustible seal member is interposed between the door frame and the door panel and is preferably comprised of a flexible outer sleeve housing a resilient metal mesh core. The door panel is latched to the door frame by a latching device that ensures that the seal member is maintained in a substantially compressed condition.

21 Claims, 9 Drawing Sheets

UNDERGROUND MINE PERSONNEL DOORS

BACKGROUND OF THE INVENTION

1. Field of the Invention

This invention relates generally to underground mine personnel doors and, more specifically, to underground mine personnel doors formed from substantially noncombustible materials and that are constructed to withstand heat generated during an underground mine fire.

2. State of the Art

In underground mining, ventilation is a primary concern to ensure air quality for those personnel working underground. Accordingly, walls (commonly referred to as "stoppings"), typically constructed of masonry materials, are required to be erected every 300 feet in seam heights below 48 inches and every 600 feet in seam heights 48 inches or higher. The main purpose for such stoppings is to control ventilation within the mine, that is to block air flow through certain passages and to direct the flow of fresh air to other passages where miners are actively working. The stoppings secondarily act as fire barriers in case of an underground mine fire to contain the fire and smoke between stoppings. In order to allow passage of personnel and equipment, personnel doors are built into the stoppings.

Under 30 C.F.R. § 75.333, personnel doors are required to be "constructed of noncombustible material and shall be of sufficient strength to serve their intended purpose of maintaining separation and permitting travel between air courses." One method of testing such doors under fire-like conditions is provided in ASTM E119-88, Standard Test Methods for Fire Tests of Building Construction and Materials, which subjects the test specimen to increasing temperatures up to 1700° F. in one hour under positive pressure. In order to sufficiently pass this test, a mine door must be able to maintain its seal between the door and the door frame during the entire duration of the test.

Despite these requirements, as described in U.S. Pat. No. Re. 34,053 to Kennedy et al., manufacturers of mine doors typically use seal members made of rubber or the like (column 6, lines 17–19). During a fire, however, such seals will burn, thus severely, if not totally, diminishing the integrity of the seal. In addition, the construction of the doors is typically not sufficient to prevent the door itself from failing structurally in the event of a fire. During a fire, the high temperatures may cause doors and frames to warp and hinges and latches to fail. Warping or any failure of hardware supporting or securing the door to the frame may cause the door panel to separate from the frame resulting in loss of integrity of the seal between the door and the frame. If such seal integrity is lost during a mine fire, the fire may be allowed to spread passed the stopping, or, at the least, allow smoke to flow between the door and the door frame. There have been attempts in the art to make such doors fire resistant. For example, in SU 860769 to Vasilenko et al., a mine door is provided with a perforated elastic sleeve that runs around the perimeter of the door and is connected to a water supply. In the event of a fire, a temperature sensor signals a valve to be opened, releasing water through the elastic sleeve to cool the door. Other liquid or gas delivery systems have also been employed with mine doors, but such systems are quite complex and expensive.

Thus, it would be advantageous to provide a mine door that is comprised of noncombustible materials as required by 30 C.F.R. § 75.333, that can withstand a fire test, such as the fire test provided in ASTM E119-88, and accordingly that has a high probability of substantially maintaining its seal in the event of a mine fire. It would also be advantageous to provide such a mine door that is relatively simple and inexpensive to fabricate.

SUMMARY OF THE INVENTION

Accordingly, a substantially fire resistant mine door is provided comprising a door panel mounted in a door frame by one or more hinges. The door panel is preferably comprised of a door skin formed from a steel sheet. Reinforcement members or cross-breaks are preferably utilized on the door to prevent the door from warping when exposed to intense heat, such as those temperatures experienced during an underground mine fire or during a fire test. Likewise, the frame is preferably structurally reinforced to prevent the frame from similarly warping. By preventing the door and frame from substantially deflecting from heat exposure, the integrity of the seal between the door and the frame can be maintained.

A heat resistant seal is interposed between the door frame and the door panel. Preferably, the seal is comprised of a resilient material to maintain the integrity of the seal even after repeated uses of the door. One such resilient seal member is comprised of a flexible outer sleeve housing a resilient core. The flexible outer sleeve may be comprised of woven fiberglass, ceramic, or other heat resistant material and the resilient core may be comprised of a metal mesh formed into a cable.

In a preferred embodiment, the sleeve includes an attachment flange along one side thereof for attachment to either the door frame or the door panel.

The door frame or the door panel preferably includes a seal retaining channel or member proximate the perimeter of the door when the door is in a closed position. In a preferred embodiment one retaining member depends from the perimeter of the door and another retaining member fits at least partially within the other retaining member, the two retaining members holding at least a portion of the seal therein-between.

Preferably, the mine door includes a latching device comprising a latch plate attached to the frame, the latch plate having an opening with an abutment surface therein for receiving and retaining a latch member, latch handles on both sides of the door, a connecting member rotatably attached to the door and extending between the two handles, and a latch member extending from either the connecting rod or one of the handles. In operation as the door is swung to a closed position, the latch member engages the opening of the latch plate until it fits within the portion of the opening defined by the abutment surface. Preferably, a biasing member, such as a spring, is attached to the latch member to bias the latch member into this portion of the opening. Such a latching device ensures that the seal member is in a substantially compressed state between the door and the frame and is thus forming the desired seal. An abutment member may also be provided to restrict rotation of the latch member past the location of the opening by the biasing member. If two or more latch members are utilized on one door, a connecting rod coupled to and extending between the latch members of the latching devices may be employed so that movement of one latch handle affects movement of each latch member.

In yet another preferred embodiment, one or more hinges are used to attach the door to the frame. Each hinge is comprised of a hinge pin fixedly mounted proximate both ends and proximate the middle to either the door or the frame and rotatably mounted at its free locations, that is between the attachment points at the ends and the attachment point or points in the middle, to the other of the door or the frame. Preferably, each hinge includes one or more biasing members, such as a coil spring to bias the door toward the frame.

In yet another preferred embodiment, the door frame is comprised of at least two substantially vertical yieldable support structures. The support structures are preferably comprised of elongate telescoping members having two or more segments that fit within each other. A roof plate is attached to one end of each support structure and a floor plate is attached to the other end of each support structure. When installed in a mine passageway, the roof plates and floor plates are bolted to the roof and floor respectively with the top of the door preferably positioned a distance below the roof of the passageway. As the roof settles or the floor heaves, the support structures will yield and allow a certain amount of movement in the roof or the floor without crushing, or otherwise inhibiting the operability of the frame or the door.

DETAILED DESCRIPTION OF THE PREFERRED EMBODIMENTS

Figure 1:
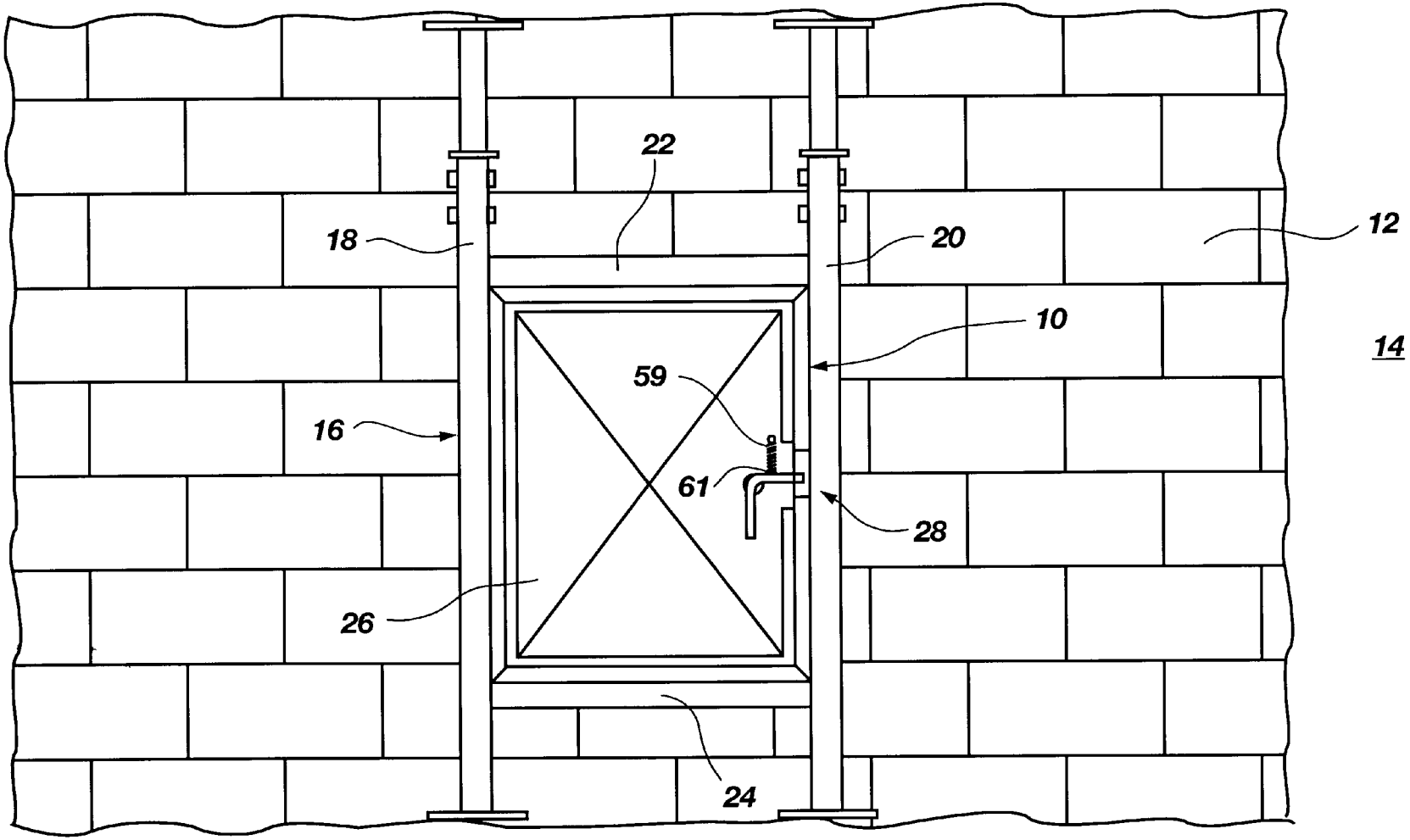
FIG. 1 is a back view of a mine door secured in a stopping in a mine passageway in accordance with the present invention.

FIG. 1 illustrates a preferred embodiment of a mine door 10 in accordance with the present invention installed in a wall 12 of masonry material (commonly referred to in the industry as a "stopping") that has been erected in an underground mine shaft or passageway 14. The mine door 10 is comprised of a frame 16 having two upright support members 18 and 20 and two cross-members 22 and 24 with the door skin or panel 26 hingedly mounted therein so that the door can swing open to allow personnel and equipment to pass or be passed through the doorway. The mine door 10 also includes one or more latching devices 28, depending on the size of the door, that latch and secure the door panel 26 to the door frame 16.

Figure 3:
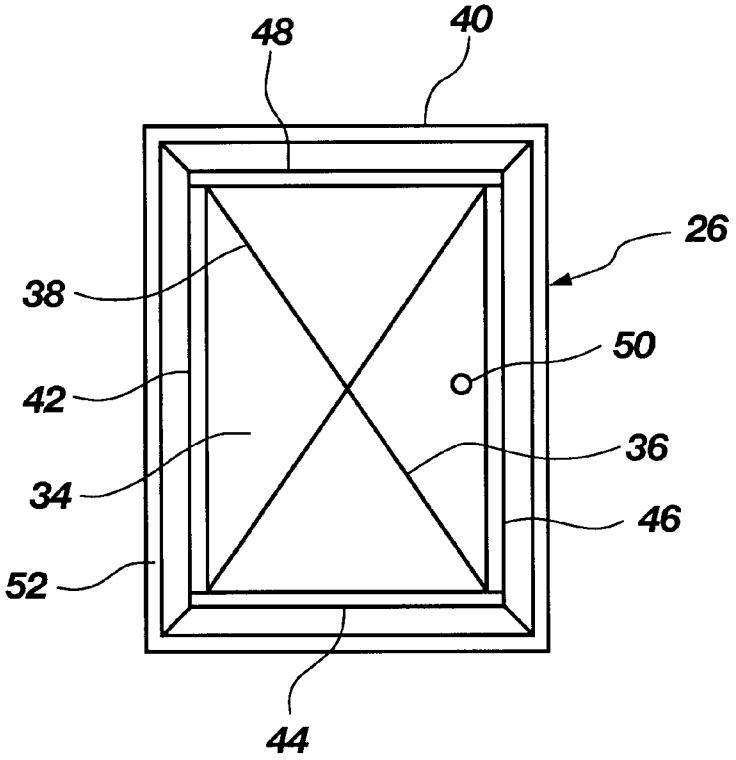
FIG. 3 is a back view of a door skin of the mine door in accordance with the present invention.
Figure 2:
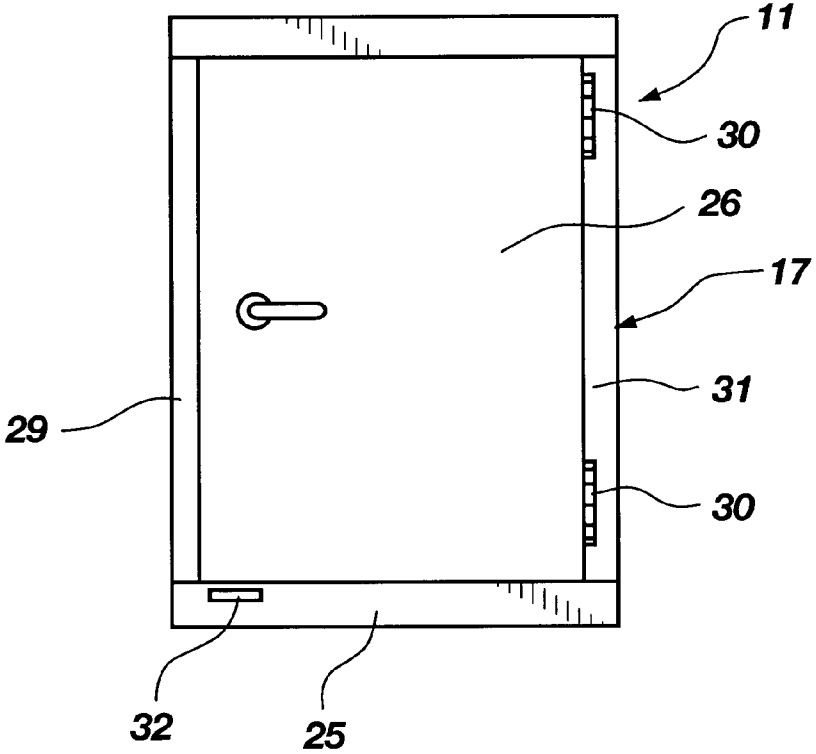
FIG. 2 is a front view of the mine door in accordance with the present invention.

As shown in FIG. 2, the door 10 includes one or more hinges 30 that mount the door panel 26 to the frame 17 and a door stop 32 comprised of an elongate member extending from the cross member 25 to prevent the door panel 26 from substantially sagging when the mine door 10 is exposed to intense heat, as may be the case in the event of an underground mine fire. In addition, the door frame 17 comprising cross members 29 and 31 may each have C-shaped cross-sections so that the stopping can fit therein and hold the door 11 in place (as later shown in FIGS. 4 and 7). FIG. 3 shows the back side of the door panel 26 comprising a substantially rectangular sheet 34 of material, preferably made of between 12 and 14 gage including cross-breaks 36 and 38 to add structural strength to the sheet 34. At a position inset from the outer perimeter 40 of the door panel 26, a plurality of structural support members 42, 44, 46, and 48 are attached to the sheet 34. The support members 42, 44, 46, and 48 may be comprised of steel tubing, preferably 1 inch×2 inch 14 gage tubing, welded to the sheet 34. The door panel 26 also includes a bore 50 cut therethrough for insertion of the latching device 28 and a seal member 52 around the perimeter 40 of the door panel 26. Of course, the seal member 52 may be comprised of one or more segments positioned end-to-end around the door perimeter 40.

Figure 4:
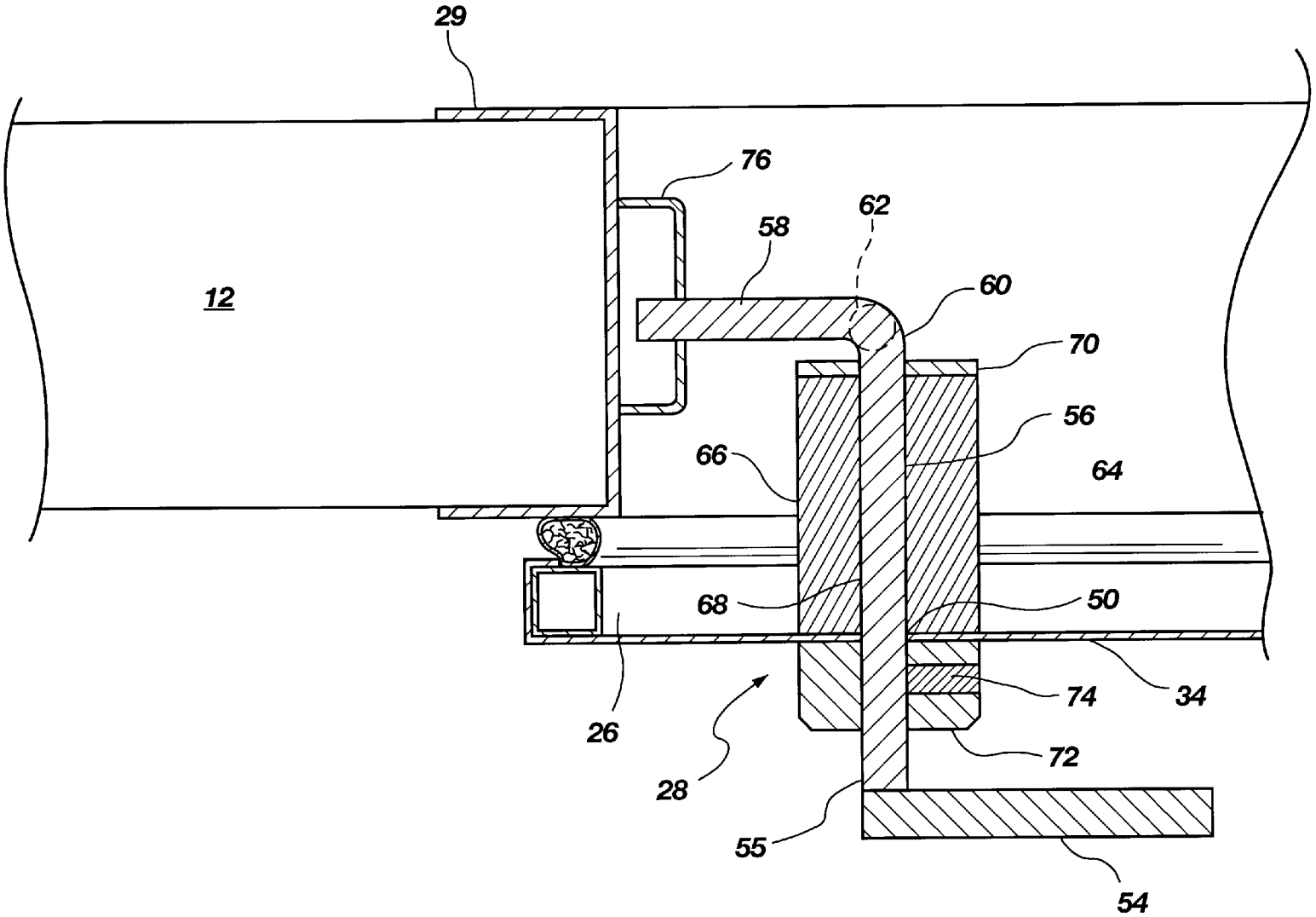
FIG. 4 is a cross-sectional top view of a latching device attached to the mine door in accordance with the present invention.

As shown in cross-section in FIG. 4, the latching device 28 is comprised of a first handle 54 attached to one end 55 of an L-shaped connecting member or interconnecting rod 56 that extends through the sheet 34 of the door panel 26. The interconnecting rod 56 is bent at approximately a 90 degree angle with the bent portion forming the latching member 58. It is also contemplated that the latch member 58 could be a separate piece from the interconnecting rod 56. Proximate to the bend 60 and depending from the interconnecting rod 56 is another handle 62 shown in dashed lines. The interconnecting rod 56 is secured to the sheet 34 by a door handle mount 64, comprised of a tubular member 66 having an internal bore 68 therethrough positioned over the bore 50 and attached to the inside of the sheet 34 as by welding. The interconnecting rod 56 extends through the tubular member 66 and is rotatable therein. An abutment member 70, such as a metal washer, is attached to the interconnecting rod 56 and abuts the tubular member 66. A locking sleeve 72 is attached to the interconnecting rod 56 by one or more set screws 74 and is positioned against the front side of the sheet 34. The interconnecting rod 56 can thus rotate relative to the door panel 26 but is longitudinally held relative thereto. In addition, the latch member 58 may be biased with a biasing member 59 such as a coiled spring with the biasing member 59 attached at one end to the door panel 26 and at the other end to the latch member 58 (see FIG. 1). Moreover, over rotation of the latch member 58 by the biasing member 59 can be prevented by providing abutment member 61 attached to the tubular member 66 and extending over the latch member 58 to prevent rotation thereof beyond a position engageable with the latch plate 76 (see FIG. 1). Similarly, a portion of the latch member 58, a portion of the handle 62, and/or a member attached to the interconnecting rod 56 proximate the bend 60 could be fitted into the tubular member 66 such that the tubular member 66 provides abutment surfaces therein and limits the range of rotation of the latch member 58.

Figure 5:
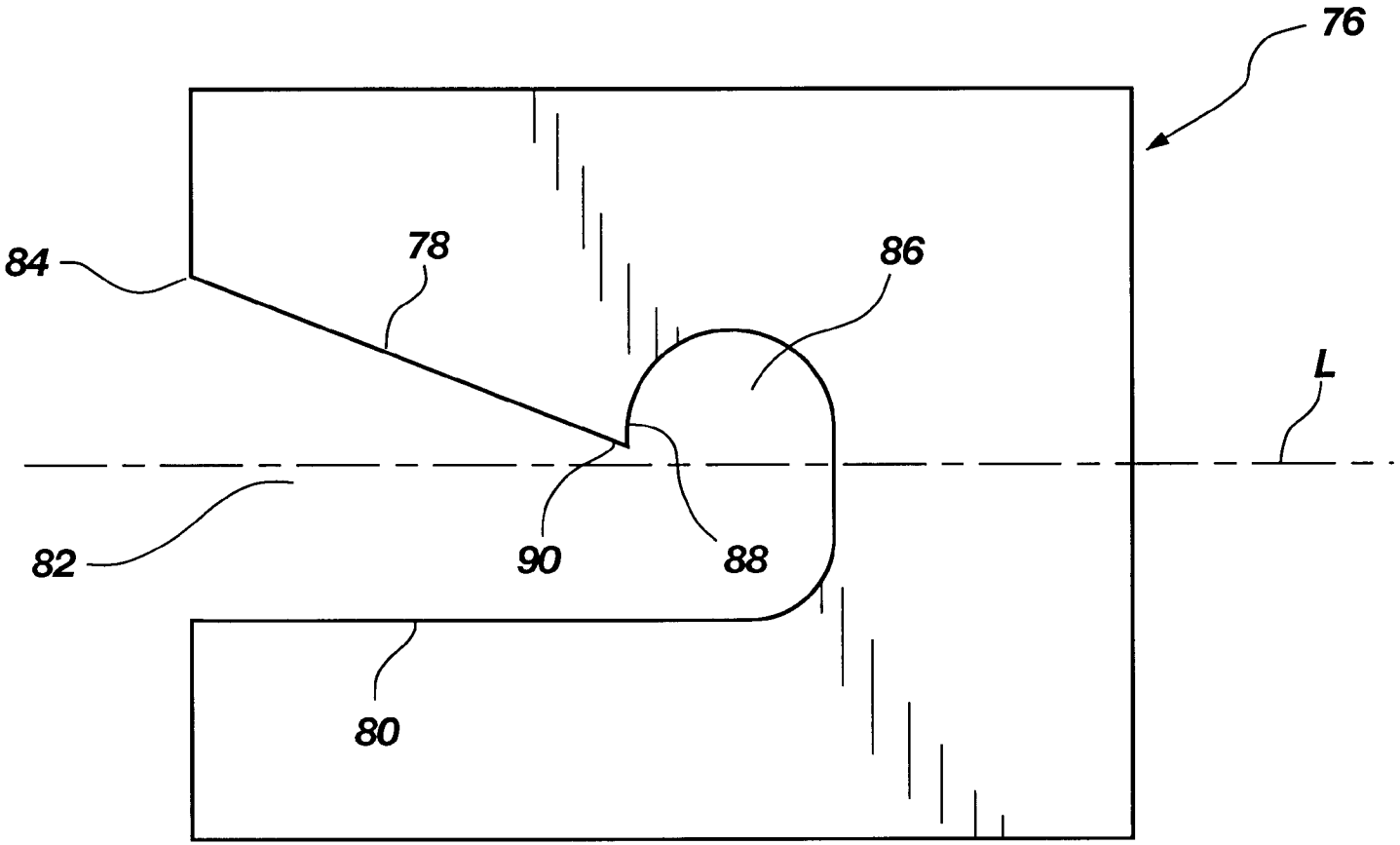
FIG. 5 is a front view of a latch plate in accordance with the present invention.

Attached to the frame member 20 is a latch plate 76 having a box-shaped configuration for receiving and retaining the latch member 58. As illustrated in FIG. 5, the latch plate 76 has first and second inner surfaces 78 and 80 defining an opening 82 therein. Preferably, surface 80 is substantially parallel to the longitudinal axis L of the latch plate 76 while surface 78 is sloped to make the opening 82 wider at the entrance 84 and narrow as the opening 82 extends into the latch plate 76. A latch member securing recess 86 is further defined in the latch plate 76 by an abutment surface 88 adjacent the internal end 90 of the sloped surface 78. Accordingly, so long as latch member 58 is aligned with the entrance 84, the latch member 58 can ride along surface 78 until it engages recess 86 and is retained therein by abutment surface 88. When engaged, the latching device 28 ensures that the seal member 52 is in a compressed state, and thus forms a seal, between the frame 16 and the door panel 26.

Figure 6:
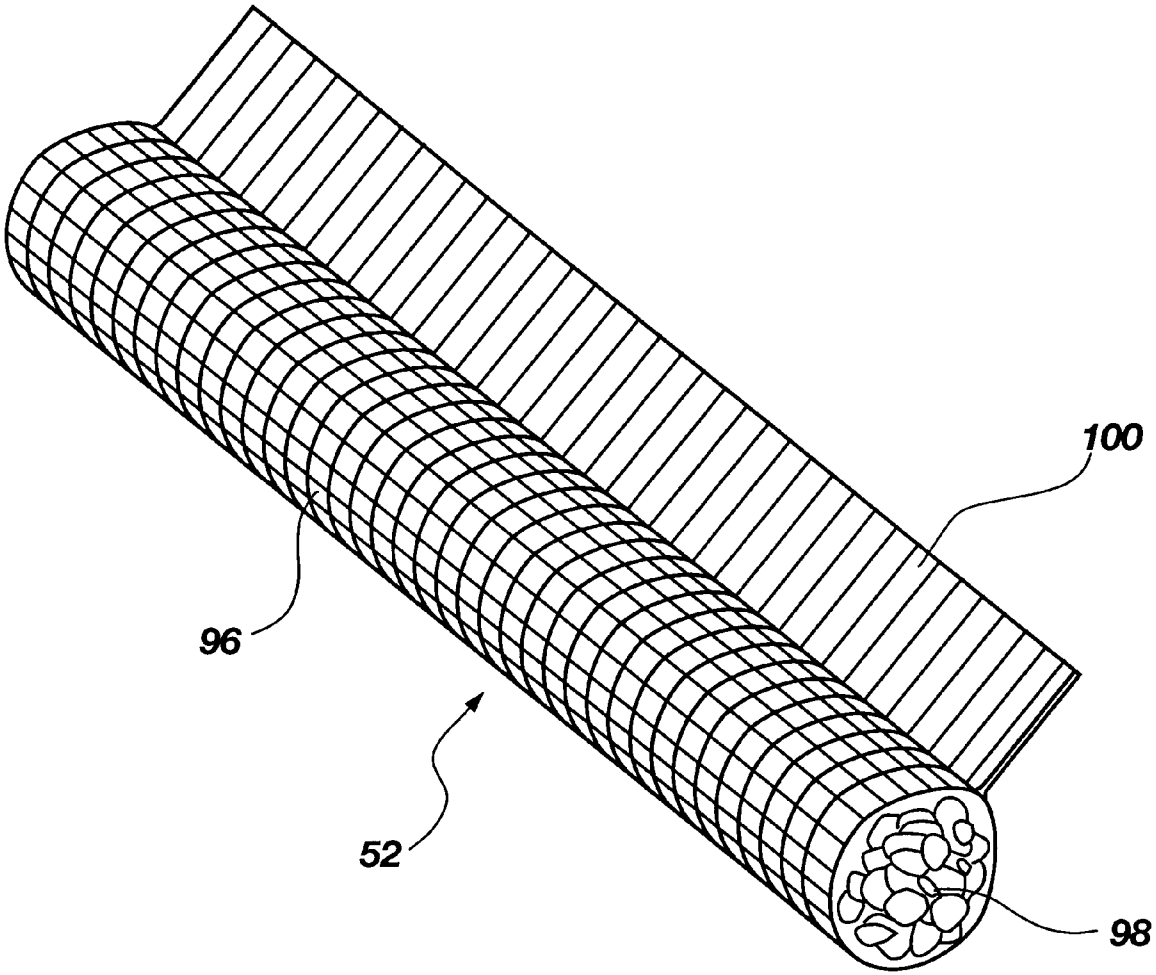
FIG. 6 is a perspective view of a seal member in accordance with the present invention.

As shown in FIG. 6, the seal member 52 is comprised of a flexible sleeve 96 housing a resilient core 98, both of which are formed from substantially noncombustible materials (e.g., materials that can withstand the ASTM E119-88 fire test). An attachment flange 100 is attached to and may be integral with the sleeve 96 so that the seal 52 can be attached to the mine door 10. The sleeve is preferably comprised of a woven fiberglass material such as vermiculite coated tetraglass tadpole tape (HYTEX) manufactured by Darco Southern Co. The core is preferably a stainless steel inconel mesh in cable form. Such a seal member is manufactured by Mid-Mountain Materials, Inc. of Seattle, Wash. Having such a resilient core is preferable so that the seal maintains its structural shape, and thus maintains seal integrity between the frame 16 and the door 26, even after repeated uses.

Figure 7:
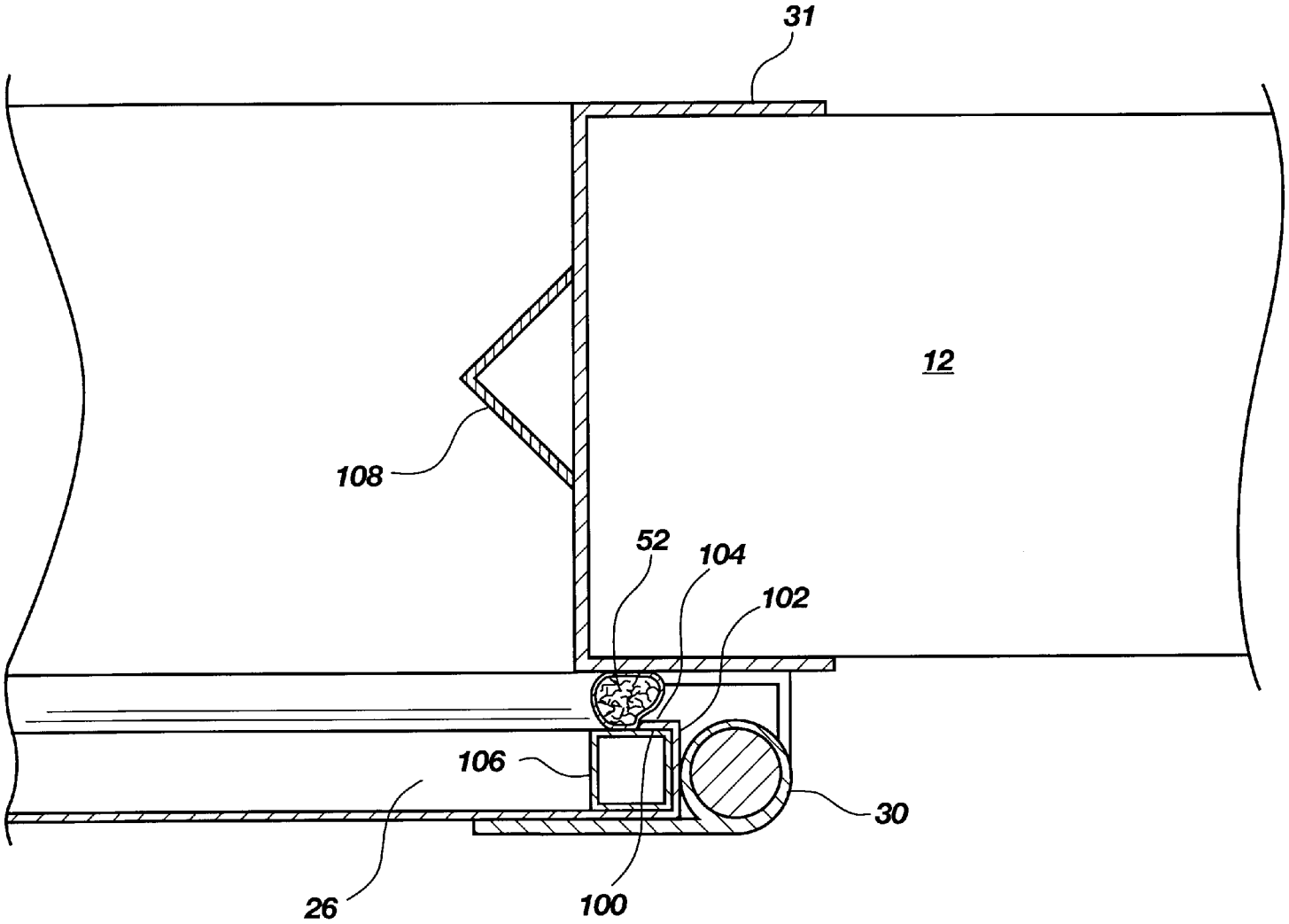
FIG. 7 is a cross-sectional top view of the seal member held between the door frame and door panel in accordance with the present invention.

Referring now to FIG. 7, the seal member 52 is held between the frame member 31 and the door panel 26 by an L-shaped retaining member 102 depending from a perimeter of the sheet 34 and a box-shaped retaining member 104 fitted within the L-shaped retaining member 92. The attachment flange 100 is thus held between the two retaining members 102 and 104 and may be further secured by crimping the flange 106 of the L-shaped retaining member 102 into the box-shaped retaining member 104.

As further illustrated in FIG. 7, the frame member 31 may be provided with an additional structural support member 108 attached thereto, as by welding, to provide support to the frame member 31 to which the door 26 is hung by hinges 30.

Figure 8:
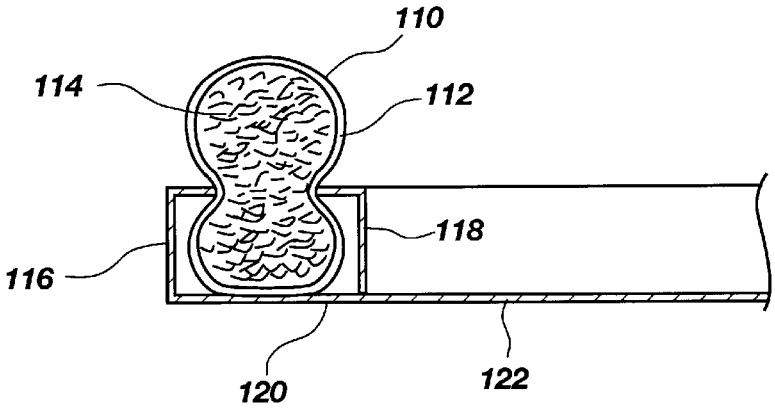
FIG. 8 is a cross-sectional top view of an alternate embodiment of a seal member in accordance with the present invention.

Referring now to FIG. 8, another preferred embodiment of a seal member 110 is illustrated being comprised of a flexible outer sleeve 112 housing an internal resilient core 114. In this embodiment, the seal member 110 is held between a pair of facing L-shaped retaining members 116 and 118 that run substantially around the perimeter of the door panel 120. The retaining member 116 may be integrally formed from the sheet 122 of the door panel 120, while the retaining member 118 may be attached to the sheet 122 as by welding. Those skilled in the art will appreciate that other configurations of seal members and seal retaining members are contemplated by the present invention and intended to be within the scope of the claims.

Figure 9:
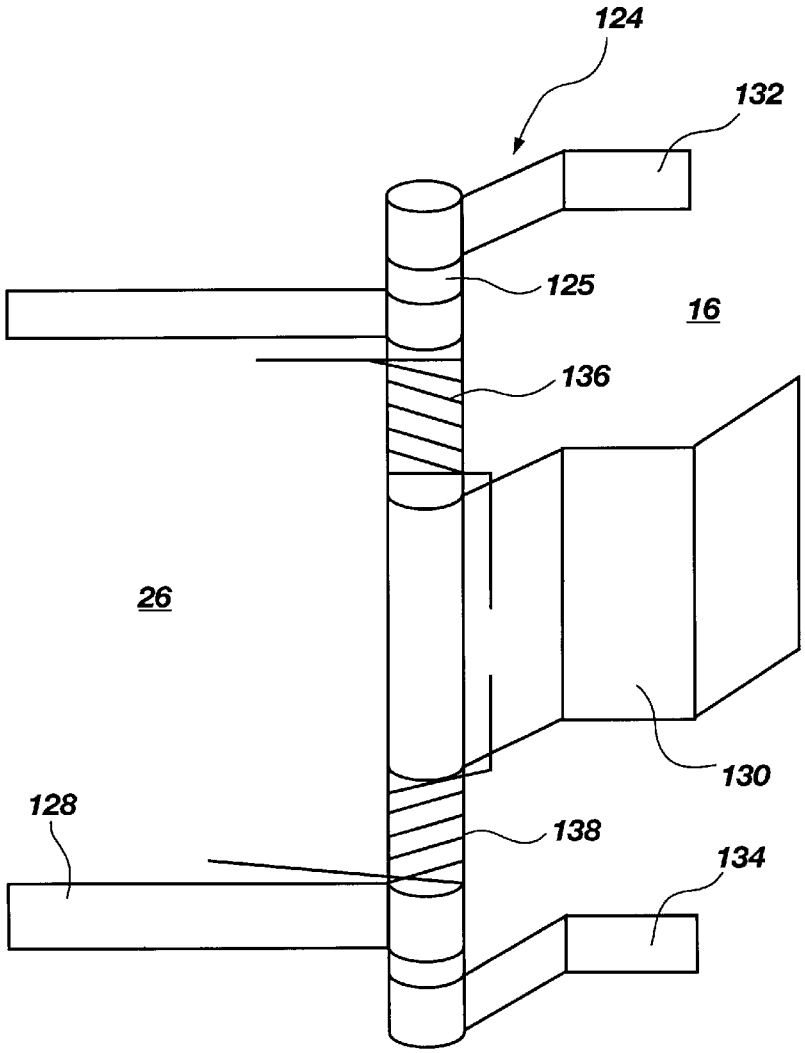
FIG. 9 is a front view of a hinge in accordance with the present invention.

Referring to FIG. 9, a hinge 124 in accordance with the present invention is illustrated comprising a hinge pin 125 to which two elongate straps 126 and 128 are rotatably attached and a center strap 130 and two end straps 132 and 134 are fixedly attached. The two elongate straps 126 and 128 are preferably attached to the door panel 26 while the center strap 130 and end straps 132 and 134 are attached to the frame 16. Two coil springs 136 and 138 are mounted between the center strap 130 and the two elongate straps 126 and 128 to bias the door panel 26 toward the frame 16. The two end straps 132 and 134 ensure that the ends of the hinge pin 125 will not substantially deflect when subjected to intense heat and thus keep the door panel 26 in relative position to the frame 16. It is understood that the elongate straps 126 and 128 could be attached to the frame with the other straps 130, 132 and 134 attached to the door and that many other configurations and combinations of straps could be utilized while still fixing the ends of the hinge pin 125.

Figure 10:
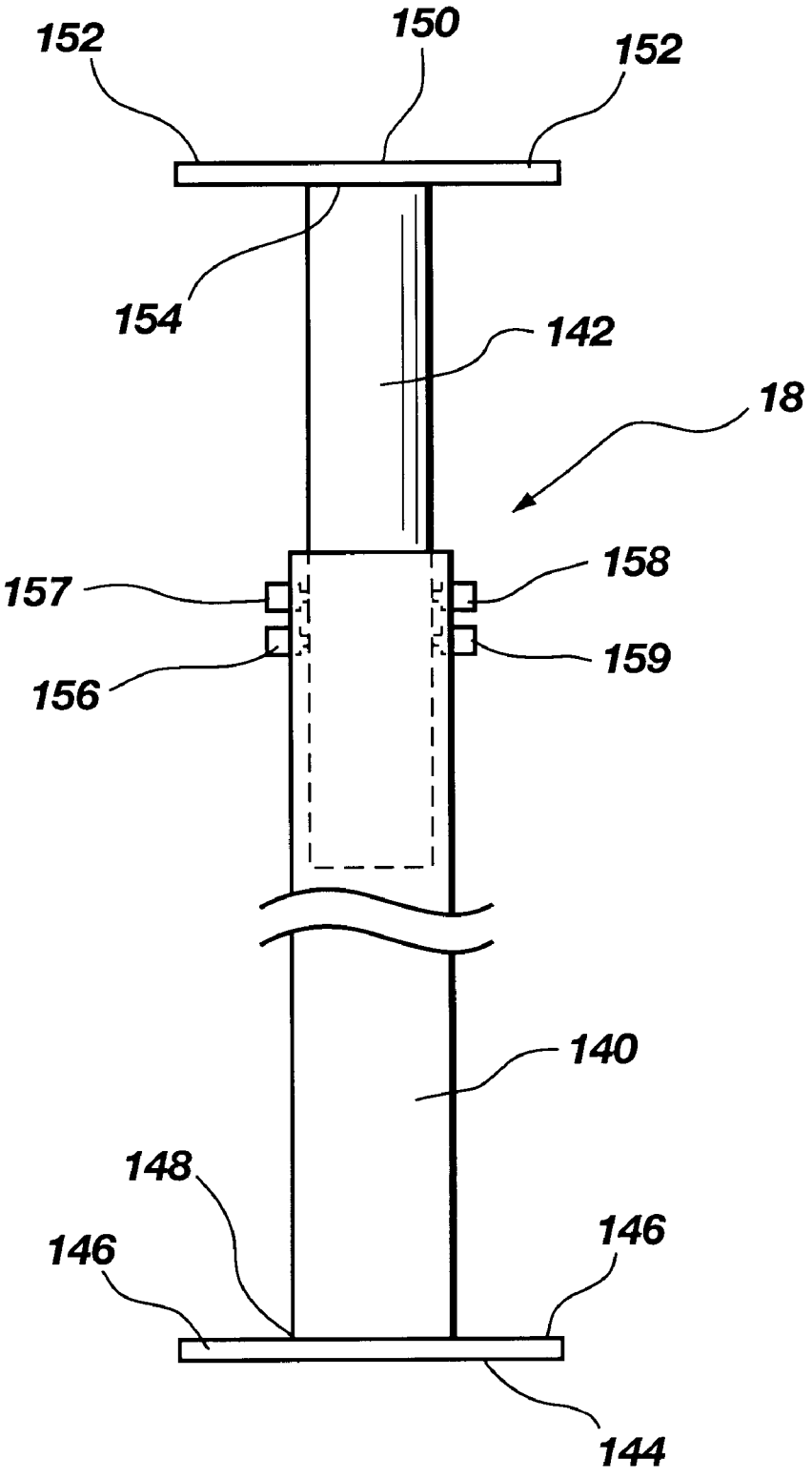
FIG. 10 is a front view of a yieldable frame member in accordance with the present invention.

The mine door 10 as illustrated in FIG. 1 is shown as including two yieldable, substantially vertical support structures 18 and 20. As illustrated in FIG. 10, one of these support structures 18 is comprised of a first elongate segment 140 into which a second elongate segment 142 fits and can slide therein. A floor plate 144 having holes 146 therein for securing the floor plate 144 to the floor of a mine passageway is attached to the free end 148 of the first elongate segment 140. Likewise, a roof plate 150 having holes 152 therein for securing the roof plate 150 to the roof of a mine passageway is attached to the free end 154 of the second elongate segment 142. The first and second elongate segments 140 and 142 thus can telescope relative to one another but are held in relative position by set screws 156, 157, 158, and 159. The set screws 156, 157, 158, and 159, while holding the two segments 140 and 142 together, allow the floor plate 144 to move relative to the roof plate 150. Thus, when installed with the mine door 10 of the present invention, the stopping 12 can collapse to some degree around the door 10 without impeding the function of the door 10. Those skilled in the art will appreciate, however, that the door 10 of the present invention has utility without the use of such yieldable supports 18 and 20 and could be employed with the simple box-type frame 17 mounted in the stopping 12 as shown in FIG. 2.

Figure 11:
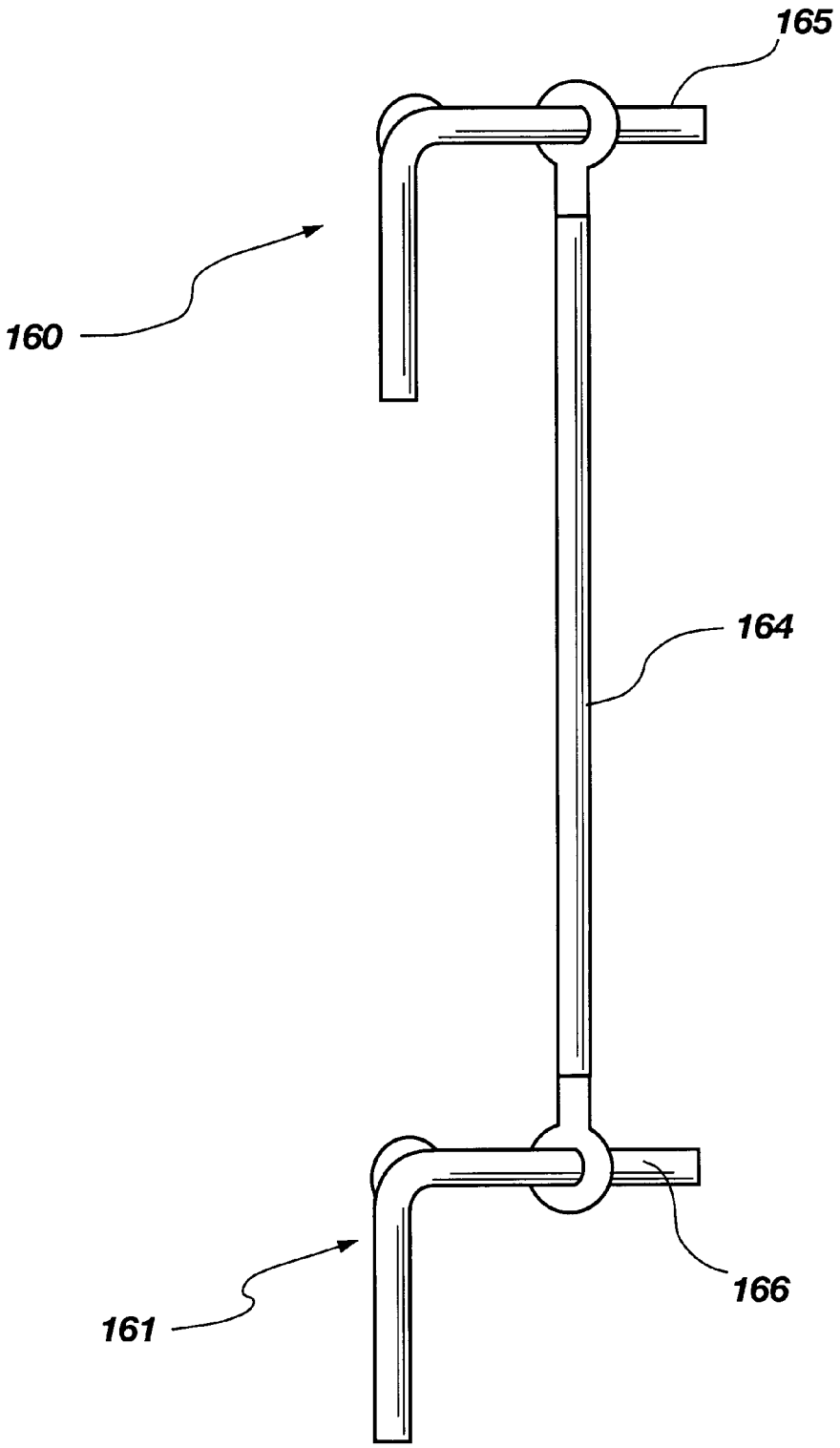
FIG. 11 is a front view of two interconnected latch members in accordance with the present invention.

Finally, in FIG. 11, it may be necessary to include at least two latching devices, 160 and 161 along with multiple hinges (not shown) in larger doors to ensure that seal integrity is maintained. Multiple latching devices 160 and 161 may be interconnected using a connecting rod 164 coupled to and between the latch members 165 and 166 as illustrated so that movement of one latch member 165 affects movement of the other latch member 166.

Accordingly, the mine door of the present invention has included many features that ensure the integrity of the seal between the door panel and the door frame even in the most adverse conditions. Thus, those skilled in the art will also appreciate that one or more features of the illustrated embodiments may be combined with one or more features from another to form yet another combination within the scope of the invention as described and claimed herein. Moreover, while certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A mine door constructed to withstand extreme temperatures, comprising:

a substantially noncombustible frame mountable in a stopping in a mine passageway, said frame having first and second upright support members and first and second cross members extending between said first and second upright members;

a substantially noncombustible door panel comprised of a metal sheet, having a front side and a back side hingedly mounted to said frame;

a plurality of reinforcing members, attached to said door panel for adding structural support to said metal sheet thereby limiting warping of said door panel when said door panel is subjected to extreme heat;

a substantially noncombustible seal member interposed between said door panel and said frame and extending around said door panel proximate a perimeter thereof, said seal member being comprised of a flexible sleeve housing a resilient metal mesh core, said metal mesh core capable of being repeatedly compressed between said door panel and said frame without substantially affecting the cross-sectional shape of the metal mesh core; and a first latching device for holding said door panel relative to said frame so that said substantially noncombustible seal member is in a compressed state between said door panel and said frame whereby said compressed seal expands to accommodate some amount of warping of said door or said frame such that seal integrity between said door panel and said frame is substantially maintained, said first latching device, comprising:

a box-shaped latch plate attached to said second upright frame member of said frame, said latch plate having first and second inner surfaces defining a latch opening having an entrance and an internal end, said latch opening narrowing from said entrance toward said internal end, said latch opening defining a recess with an abutment surface proximate said internal end;

a first latch handle proximate said front side of said door panel and a second latch handle proximate said back side of said door panel;

a connecting member extending through said door panel interconnecting said first handle to said second handle and rotatable secured to said door panel;

a latch member associated with said connecting member positioned and oriented to be received within said latch opening and being engageable with said recess of said latch plate when said door panel is in a closed position and said seal member is in a compressed state, whereby rotation of one of said first and second handles releases said latch member from said recess; and a biasing member associated with said latch member for biasing said latch member into said recess;

whereby said mine door is capable of substantially maintaining a seal between said frame and said door panel when subjected to temperatures up to 1700 degrees Fahrenheit.

2. The mine door of claim 1, further including at least one abutment member associated with said latching device to restrict rotation of said latch member in at least one direction.

3. The mine door of claim 1, wherein said first inner surface of said latch opening is sloped relative to a longitudinal axis of said latch plate and said second inner surface is substantially parallel to a longitudinal axis of said latch plate narrowing said latch opening as said latch opening extends into said latch plate.

4. The mine door of claim 1, further including a second latching device having a latch member for holding said door panel relative to said frame so that said substantially noncombustible seal member is in a compressed state between said door panel and said frame and a connecting rod coupled to and extending between said latching members of said first and second latching devices.

5. The mine door of claim 1, wherein said flexible sleeve is comprised of tetraglass.

6. The mine door of claim 5, wherein said flexible sleeve is comprised of vermiculite coated tetraglass.

7. The mine door of claim 1, wherein said metal mesh is comprised of inconel.

8. The mine door of claim 1, wherein said flexible sleeve further includes an attachment flange along one side thereof.

9. The mine door of claim 8, wherein said door panel further comprises:

a substantially rectangular door skin defining a door perimeter;

at least one first retaining member depending from said door skin proximate to and along a substantial portion of said door perimeter defining at least one retaining channel;

at least one second retaining member fitted at least partially within said retaining channel; and said attachment flange of said flexible outer sleeve held between said at least one first retaining member and said at least one second retaining member.

10. The mine door of claim 7, wherein said at least one first retaining member comprises a first wall depending substantially perpendicularly from said door skin and a second wall depending substantially perpendicularly from said first wall and toward said door panel to form an L-shaped retaining member and said at least one second retaining member comprises a substantially rectangular tube sized to fit within said L-shaped retaining member.

11. The mine door of claim 1, wherein said metal sheet includes cross-breaks to reduce warping of said door panel when subjected to extreme heat.

12. The mine door of claim 1, wherein said frame includes at least one frame reinforcing member attached to said first upright member of said frame for adding structural support to said first upright member.

13. The mine door of claim 1, wherein said frame includes at least two substantially vertical, completely independently operable, yieldable support structures.

14. The mine door of claim 13, wherein said at least two substantially vertical yieldable support structures are each comprised of an elongate telescoping member having at least two segments, a roof plate attached to a first end, and a floor plate attached to said second end.

15. The mine door of claim 14, wherein each said elongate telescoping member further includes at least one fastener yieldably fastening said at least two segments together.

16. The mine door of claim 1, wherein said door panel is hingedly mounted to said frame by at least one hinge, said at least one hinge including a hinge pin fixedly mounted proximate first and second ends and proximate a middle portion thereof to one of said frame and said door panel and rotatably mounted proximate at least one free location to the other of said frame and said door panel.

17. The mine door of claim 16, wherein said at least one hinge further includes at least one biasing member for biasing said door panel toward said frame.

18. The mine door of claim 1, wherein said substantially noncombustible seal member is comprised of a plurality of segments positioned end-to-end.

19. The mine door of claim 1, further including a door stop attached to said frame proximate a lower edge of said door panel for preventing said door panel from substantially sagging when said mine door is exposed to intense heat.

20. The mine door of claim 1, wherein said recess is positioned substantially above a longitudinal axis of said latch plate, said biasing member being configured to maintaining said latch member in said recess as said door panel sags from exposure to intense heat.

21. A mine door constructed to withstand extreme temperatures, comprising:

a substantially noncombustible frame configured to be mountable in an underground mine passageway, said frame having first and second upright support members and first and second cross members extending between said first and second upright members;

a substantially noncombustible door panel comprised of a metal sheet having a first side, a second side, a front side and a back side and hingedly mounted to said frame about said first side;

a substantially noncombustible seal member interposed between said door panel and said frame and extending around said door panel proximate a perimeter thereof, said seal member being comprised of a flexible sleeve housing a resilient metal mesh core, said metal mesh core capable of being repeatedly compressed between said door panel and said frame without substantially affecting the cross-sectional shape of the metal mesh core; and at least one latching device for holding said door panel relative to said frame so that said substantially noncombustible seal member is in a compressed state between said at least one door panel and said frame, comprising:

a latch plate attached to said frame proximate said second side of said door panel, said latch plate said latch plate having first and second inner surfaces defining a latch opening having an entrance and an internal end, said latch opening narrowing from said entrance toward said internal end, said latch opening defining a recess with an abutment surface proximate said internal end;

a first latch handle proximate said front side of said door panel and a second latch handle proximate said back side of said door panel;

a connecting member extending through said door panel interconnecting said first handle to said second handle and rotatably attached to said door panel; and a latch member associated with said connecting member positioned and oriented to be received within said latch opening and being engageable with said recess of said latch plate when said door panel is in a closed position and said seal member is in a compressed state, whereby rotation of one of said first and second latch handles releases said latch member from said recess; and a biasing member associated with said latch member for biasing said latch member into said recess, whereby said mine door is capable of substantially maintaining a seal between said frame and said door panel when subjected to temperatures up to 1700 degrees Fahrenheit.

* * * * *